Figure 1:
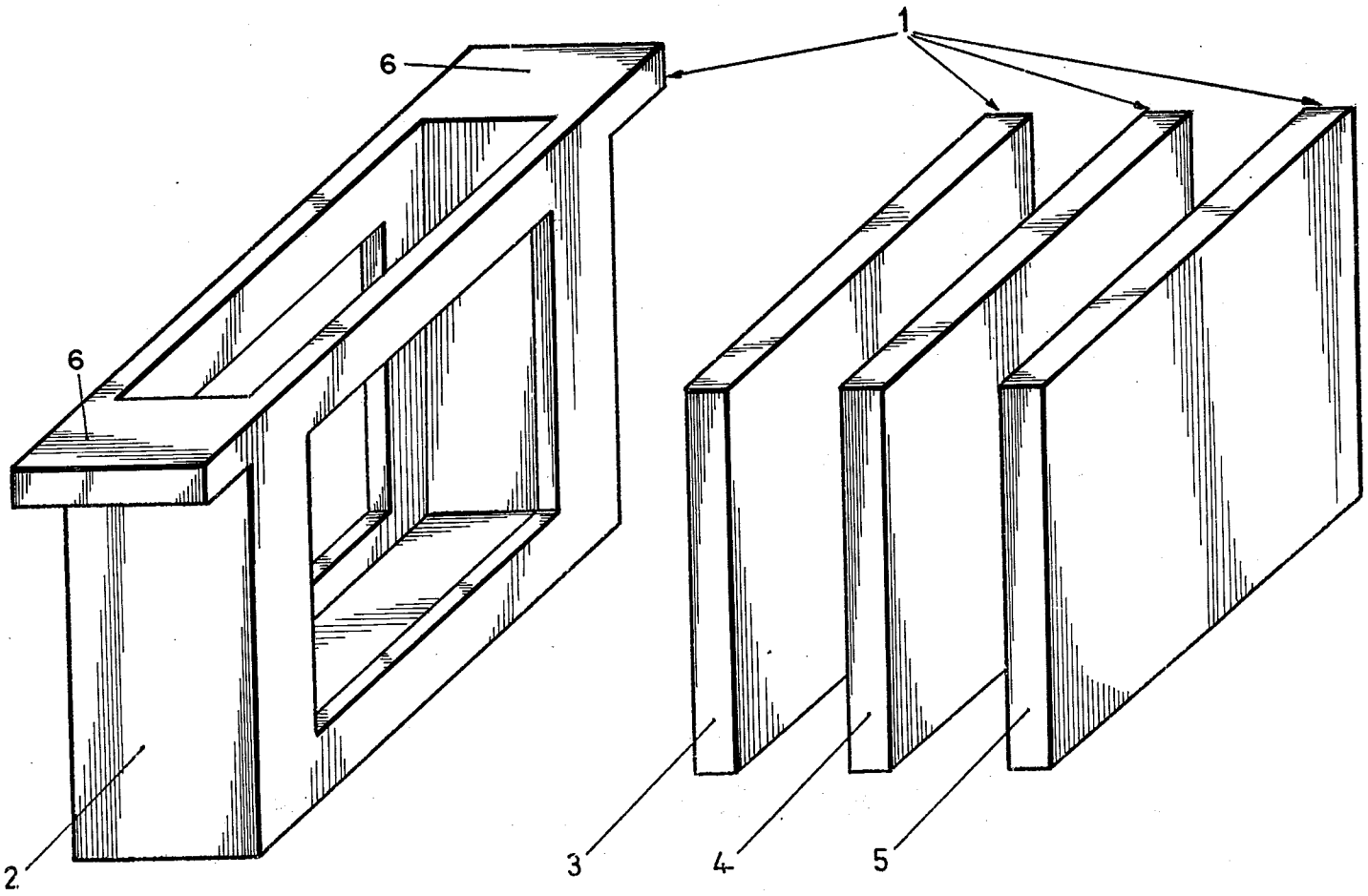

Table 4.

| Alloy (A.A.) | Color of film | Name of alloy | Color of film |
|---|---|---|---|
| 1100 | Brown | 5052 | Yellowish brown |
| 2011 | Blackish brown | 5086 | Blackish brown |
| 2014 | Blackish brown | 5357 | Grayish brown |
| 2024 | Yellowish brown | 6061 | Blackish brown |
| 3003 | Blackish brown | 6063 | Yellowish brown |
| 4043 | Blackish brown | 7075 | Yellowish brown |
| 5005 | Blackish brown | | |

Table 4 indicates that the color of the colored oxide film of the aluminum material containing much iron becomes darker with an increase in the amount of iron contained. By observing the constructions of all the films, it was found that sulfur and/or sulfides were deposited in the lattice defects in any one of the films.

As will be seen from the foregoing, with the present invention, a colored oxide film is obtained by effecting an anodic oxidizing treatment in an aqueous solution containing sulfuric acid, without employing any coloring additives. Accordingly, this invention has the following advantages.

1. The electrolytic solution is simple in composition and economical and control of the bath is easy.

2. Since sulfuric ions serving as coloring sources enter into lattice defects of an aluminum oxide film during its formation, the resulting color is constant and uniform and does not ever deteriorate the characteristic of the film.

3. Electrolysis is carried out in the aqueous solution containing sulfuric acid and productivity is also very excellent.

The aluminum material or an aluminum alloy herein mentioned is intended to cover an industrially pure aluminum, any other various aluminum alloys and, especially, those aluminum alloys containing oxidizable alloying elements but to exclude alloys containing a large amount of, for example, copper.

We claim as our invention:

1. A method of forming a colored oxide film on aluminum which contains incidental impurities and on aluminum alloys by electrolyzing the aluminum material by applying a rectangular pulse voltage thereto in an electrolytic bath consisting essentially of an aqueous solution of sulfuric acid to form an aluminum oxide film containing aluminum suboxides and having crystal lattice defects on the surface of the aluminum material, said rectangular pulse voltage having a peak voltage value in the range of from about 5 volts to about 120 volts and a period in the range of from about 0.2 seconds to about 120 seconds.

2. A method of forming a colored oxide film on an aluminum material according to claim 1, wherein said rectangular pulse voltage includes a positive pulse voltage for the formation of the aluminum oxide film and for driving the sulfuric ions into the lattice defects.

3. A method of forming a colored oxide film on an aluminum material according to claim 2, wherein said rectangular pulse voltage includes a negative pulse voltage to promote the reduction of the sulfuric ions to form sulfur and sulfides.

4. A method of forming a colored oxide film on an aluminum material according to claim 1, wherein the aqueous solution contains 5 to 90% by weight of sulfuric acid.

5. A method of forming a colored oxide film on an aluminum material according to claim 1, wherein the aluminum material is an aluminum alloy containing an element whose affinity with oxygen is equal to or stronger than that of aluminum or stronger than copper.

* * * * *

United States Patent [19]

Alder

[11] 3,930,967

[45] Jan. 6, 1976

[54] PROCESS FOR THE ELECTROLYSIS OF A MOLTEN CHARGE USING INCONSUMABLE BI-POLAR ELECTRODES

[75] Inventor: Hanspeter Alder, Flurlingen, Switzerland

[73] Assignee: Swiss Aluminium Ltd., Chippis, Switzerland

[22] Filed: July 3, 1974

[21] Appl. No.: 485,343

[30] Foreign Application Priority Data

Aug. 13, 1973 Switzerland ..... 11646/73

[52] U.S. Cl. ..... 204/67; 204/64 R; 204/244; 204/268; 204/290 R

[51] Int. Cl.[2] ..... C25C 3/00; C25C 7/02

[58] Field of Search ..... 204/64 R, 67, 243 R, 244–247, 204/254–256, 268, 290 R

[56] References Cited

UNITED STATES PATENTS

| | | | |
|---|---|---|---|
| 2,480,474 | 8/1949 | Johnson | 204/268 |
| 2,959,527 | 11/1960 | De Varda | 204/67 |
| 3,178,363 | 4/1965 | De Varda et al. | 204/67 |
| 3,554,893 | 1/1971 | De Varda | 204/244 |
| 3,562,122 | 2/1971 | Thieme et al. | 204/64 R |
| 3,578,580 | 5/1971 | Schmidt-Hatting et al. | 204/244 |
| 3,586,613 | 6/1971 | Stewart | 204/67 |
| 3,647,673 | 3/1972 | De Varda et al. | 204/244 |
| 3,718,550 | 2/1973 | Klein | 204/67 |
| 3,732,157 | 5/1973 | DeWitt | 204/268 |
| 3,775,099 | 8/1973 | Haupin | 204/64 R |
| 3,785,941 | 1/1974 | Jacobs | 204/246 X |

*Primary Examiner*—John H. Mack
*Assistant Examiner*—Aaron Weisstuch
*Attorney, Agent, or Firm*—Ernest F. Marmorek

[57] ABSTRACT

A process for the production of metals by the electrolysis of metal compounds dissolved in a molten electrolyte, in particular for the production of aluminum from aluminum oxide. The electric power is passed through a multi-cell furnace with at least one inconsumable bi-polar electrode, made of electrode materials which are compatible with one another. The anions, in particular, the oxygen ions of the dissolved metal compounds have their charges removed on the surface of the electron conductive ceramic oxide anode and the metal ions, in particular the aluminum ions on the surface of the cathode which is made of another material than that used for the anode surface.

31 Claims, 4 Drawing Figures

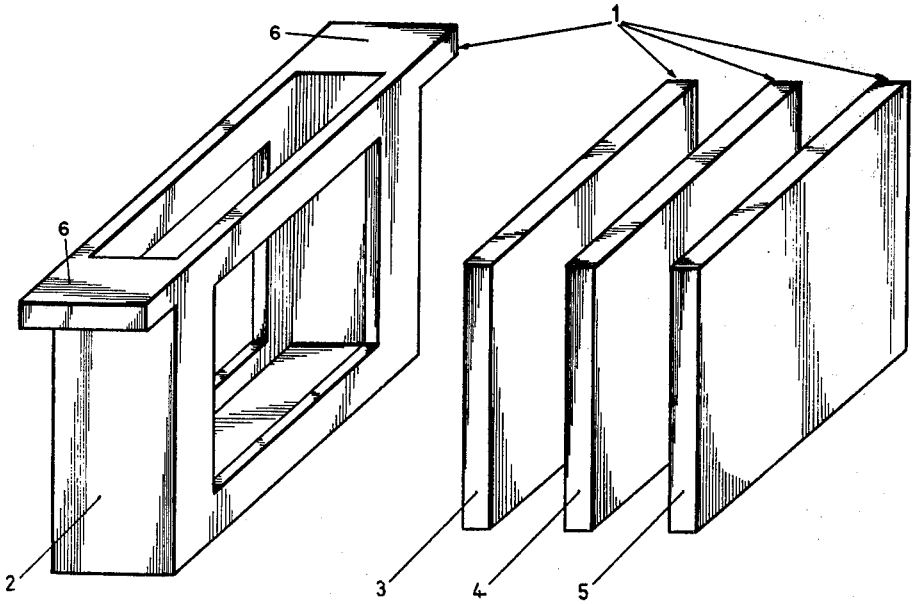

PROCESS FOR THE ELECTROLYSIS OF A MOLTEN CHARGE USING INCONSUMABLE BI-POLAR ELECTRODES

The invention concerns a process for the production of metals, in particular aluminum, and a multi-cell furnace fitted with inconsumable bi-polar electrodes for carrying out the process.

In the Hall-Heroult process for the electrolysis of aluminum a cryolite melt containing dissolved $Al_2O_3$ is electrolysed at 940° – 1000°C. The precipitated aluminum collects on the cathodic carbon floor of the electrolysis cell whilst $CO_2$ and to a small extent CO form on the carbon anode. As a result of this the anode burns away.

For the reaction $$Al_2O_3 + 3/2\ C \rightarrow 2\ Al + 3/2\ CO_2$$

the combustion of the carbon consumes, theoretically, 0.334 kg C/kg Al; in practice however up to 0.5 kg C/kg Al is consumed.

Consumable carbon anodes have various disadvantages:

In order to maintain an acceptable purity of aluminum in production a pure coke with low ash content must be employed for the anode carbon.

Because the carbon anode is burnt away it has to be advanced from time to time in order to re-establish the optimum interpolar distance between the surface of the anode and the surface of the aluminum. Pre-baked anodes have to be replaced periodically by new ones and continuously fed anodes (Soderberg anodes) have to be re-charged.

In the case of pre-baked anodes a separate manufacturing plant, the anode plant, is necessary.

In the case of a 120 kA furnace with pre-baked, discontinuous anodes, the following typical voltage losses are experienced:

| | |
|---|---|
| loss due to conduction (anodic, cathodic) | 0.2 Volt |
| Anode | 0.2 Volt |
| Cathode | 0.3 Volt |
| | 0.7 Volt |

For an average cell voltage of 3.9 volt this amounts to a loss of 19%.

The disadvantages can, for the main part, be removed by using a multi-cell furnace with inconsumable bi-polar electrodes, on which the separation of the metal oxide into its elements takes place.

The advantages of such a furnace for electrolysis are:

The consumption of anodes is eliminated.

The electrodes are rigidly fixed and so the interpolar distance remains constant The voltage loss through the electrodes is considerably reduced.

An encapsulated furnace with automatic control can be constructed.

The oxygen formed at the anode can be led off for further industrial use.

The arrangement of several electrodes in the charge being electrolysed, permits a larger production of metal in unit time for a given surface area, without having to change the outer dimensions of the cell.

Working conditions are improved and problems with the contamination of the environment are reduced.

Furnaces with several bi-polar electrodes for the production of aluminum are known and from time to time have been proposed. The Swiss patent 354,258 describes an arrangement of parallel, fixed bi-polar electrodes for the electrolysis of a molten charge. The sides of the anodes are of carbon which burns away as the electrolysis progresses and so they have to be replaced. This cell exhibits thereby serious disadvantages.

Also the Swiss patent 492,795 refers to an arrangement of parallel, fixed bi-polar electrodes for the electrolysis of a molten charge of metal oxides. The sides of the anodes consist, on the surface, of a layer which is conductive to oxygen ions and consists for example of zirconium oxide or cerium oxide stabilised with additions of other metal oxides. The $O^{2-}$ ions diffuse through this layer, are oxidised to oxygen on a porous electron conductor and escape through the porous structure. As a further construction another $O^{2-}$ ion-containing electrolyte which is liquid at the operating temperature, can be positioned between the oxygen-ion conductive layer and the anode core. In this way the need for a porous electron conductor is avoided.

Such a multi-cell furnace functions with inconsumable electrodes and consists essentially of the following:

Molten electrolyte charge — oxygen-ion conductor — auxiliary electrolyte — electron conductor — cathode — molten electrolyte charge —

In practice it has been shown however that the choice of material which is conductive to oxygen ions is limited, as most are not sufficiently stable in the electrolyte at the operating temperature. In a cryolite melt at 960°C the stabilising metal oxide is often dissolved out of the lattice after only a few hours, producing a change in the crystal structure and making the material unusable.

The object of the invention presented here is to develop a process for the production of metals, in particular aluminum, by the electrolysis of a molten charge containing dissolved metal compounds, by making use of a multi-cell furnace which does not exhibit the above mentioned difficulties and is easier to carry out than the system described above.

The object of this invention is accomplished by passing the electric current through a multi-cell furnace which has at least one inconsumable electrode consisting of electrode materials which are compatible, whereby the anions, in particular oxygen ions of the dissolved metal compounds have their charges removed on the surface of the anode made of electron-conductive ceramic oxide material, and the metal ions, in particular the aluminum ions have their charges removed on the surface of the cathode made of another material than is on the anode surface.

The multi-cell furnace of the process for this invention consists of the following:

Molten electrolyte charge — electron conductive anode — cathode — molten electrolyte charge —

Since anode and cathode are often not sufficiently compatible with each other at elevated temperatures, they can be separated by an intermediate layer.

For the the free anode surface which comes into contact with the corrosive molten electrolyte, an oxide based material comes into consideration, for example oxides of tin, iron, chromium, cobalt, nickel or zinc.

However these oxides can generally not be densely sintered without additives and furthermore, exhibit a relatively high specific resistivity at 1,000°C. For this reason additions of at least one other metal oxide in a concentration of 0.01 to 20 weight %, preferably 0.05 to 2% have to be made in order to improve the properties of the pure oxide.

Oxides of the following metals which may be used alone or in combination with one another, have been proved to be useful in increasing the sinterability, the density and the conductivity. These metals are:

Fe, Sb, Cu, Mn, Nb, Zn, Cr, Co, W,
Cd, Zr, Ta, In, Ni, Ca, Ba, Bi.

Processes which are well known in the technology of ceramics can be used to produce ceramic oxide bodies of this kind. The oxide mixture is ground, shaped by pressing or via a slurry, and sintered by heating at a high temperature.

Besides this the oxide mixture can also be applied to a substrate as a coating whereby the substrate can to advantage serve as a separating layer between the anode and cathode surfaces of the electrodes. The oxide mixture is put on to the substrate by hot or cold pressing, plasma or flame spraying, explosive cladding, physical or chemical deposition from the gas phase or by another known method, and if necessary is sintered. The bonding of the coating to the substrate is improved if before coating the substrate surface is roughened mechanically, electrically or chemically, or if a wire mesh is welded on to it.

Oxide anodes of this kind have the following advantages:

good resistance to damage under conditions of thermal cycling.
low solubility in the molten electrolyte at 1,000°C
low specific resistivity
Resistance against oxidation
Negligible porosity Usefully, anodes of 80 – 99.7% $SnO_2$ and with a porosity of less than 5% are employed. At an operating temperature of 1,000°C these have a specific resistivity of 0.004 Ohm. cm and a solubility in the cryolite melt of less than 0.08%. These conditions are fulfilled for example by the addition of 0.5 – 2.0% CuO and 0.5 – 2% $Sb_2O_3$ to the base material of $SnO_2$.

It has been found that ceramic oxide material with tin oxide as its basis is rapidly eaten away when dipped in a molten electrolyte which has aluminum suspended in it.

This corrosion can be substantially reduced if the anode surface in contact with the melt carries an electric current. For this the minimum current density must amount to 0.001 A/cm$^2$, however to advantage at least 0.01 A/cm$^2$ is used, in particular at least 0.025 A/cm$^2$.

If a bi-polar electrode bearing the previously prescribed minimum current density is so arranged that the free anode surface is not completely immersed in the melt, then a substantial amount of ceramic oxide material can still be removed at those places where the anode surface is simultaneously in contact with the molten charge and the atmosphere. The atmosphere is composed, in addition to air, of gas formed at the anode, in particular oxygen, electrolyte vapour and possibly fluorine. The electrodes are therefore advantageously so arranged that at least the free working surface of the anode is completely immersed in the molten electrolyte.

The cathode is, as a rule, made of carbon in the form of a calcined block or graphite. It can however also be made out of another electrolyte-resistant material which is electron conductive, such as borides, carbides, nitrides or silicides, preferably the elements C and Si of the IV main group, the metals of the IV – VI subgroup of the periodic system of elements or mixtures of these, in particular titanium carbide, titanium boride, zirconium boride or silicon carbide.

As with the anode, the cathode can be put on the intermediate layer as a coating using one of the known methods.

If necessary an intermediate layer may be arranged between anode and cathode layers the purpose of this intermediate layer being to prevent direct contact between the ceramic oxide and the cathode. The ceramic oxide could be reduced at the operating temperature by a cathode layer of carbon.

The following demands are made of the intermediate layer good electrical conductivity
no reaction with anode or cathode materials.

Materials which could be considered for the intermediate layer are preferably metals for example silver, nickel, copper, cobalt, molybdenum or a suitable carbide, nitride, boride, silicide or mixtures of these fulfilling the requirements. Silver has the advantage that at an operating temperature above 960°C it is liquid and therefore provides a particularly good contact.

At the same time such an intermediate layer with the conductivity of a metal facilitates the uniform distribution of electric current over the whole of the electrode plate.

Although in general an intermediate layer is used, by making use of suitable anode and cathode materials which do not react with each other at the operating temperature, it can be omitted. The individual components of the bi-polar electrode are held together by a material which is stable and is a poor electrical conductor at the operating temperature and for example can be made into a frame. By way of preference a refractory nitride or oxide such as boron nitride, silicon nitride, aluminum oxide or magnesium oxide is used.

Both sides of the bi-polar electrode are in contact with the molten electrolyte during the electrolysis process. The molten electrolyte can, as is normal in practice, consist of fluorides, above all cryolite, or of a mixture of oxides as stated in technical literature on this field. The removal of the charge from the $O^{2-}$ ions takes place at the interface between melt and ceramic and the gaseous oxygen formed escapes through the melt. The metal ions are reduced at the cathode.

In terms of the invention several of the described electrodes can be arranged in series between a cathode at one end and an anode at the other end of a furnace for the electrolysis of a molten charge.

Figure 2:
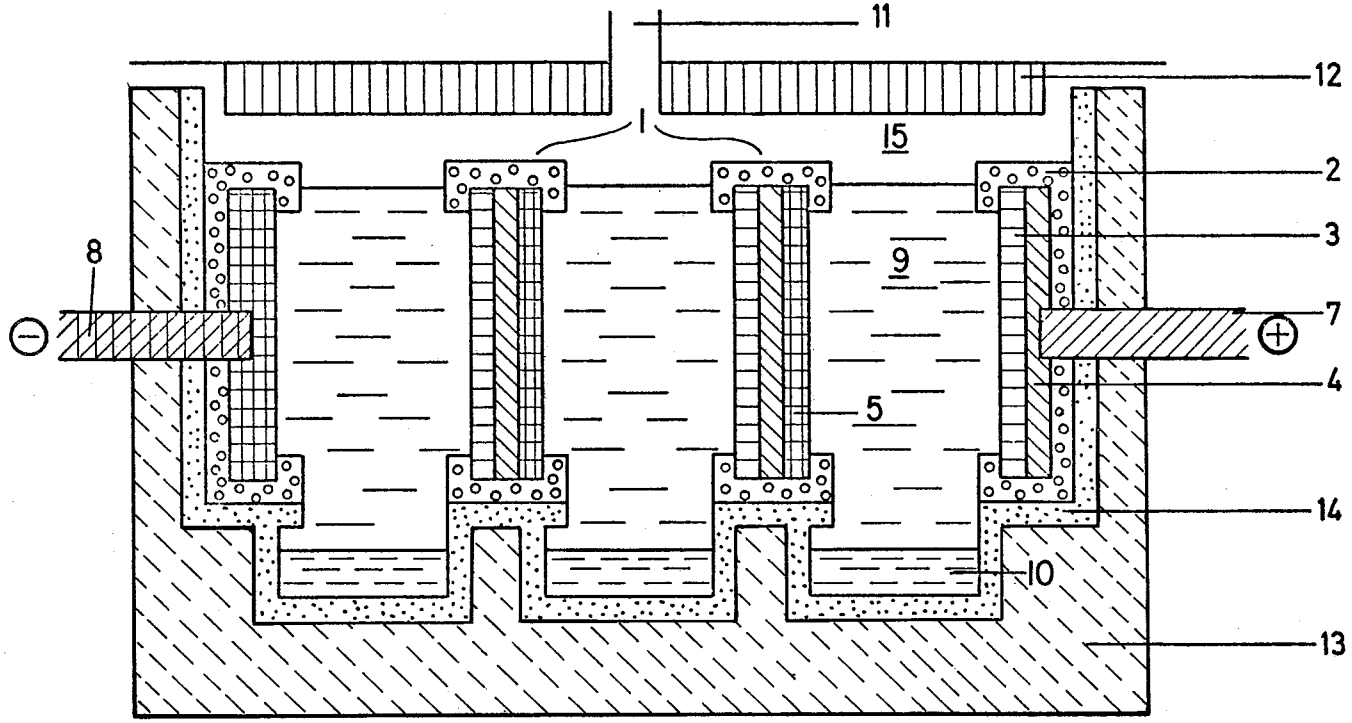

A number of various designs of the bi-polar electrode of the invention and cells fitted with these are shown schematically in the figures and show as follows:

FIG. 1 A perspective drawing of the individual parts of an inconsumable bi-polar electrode FIG. 2 A vertical section through an electrolytic furnace for the production of aluminum and fitted with bi-polar electrodes of the kind shown in FIG. 1.

Figure 3:
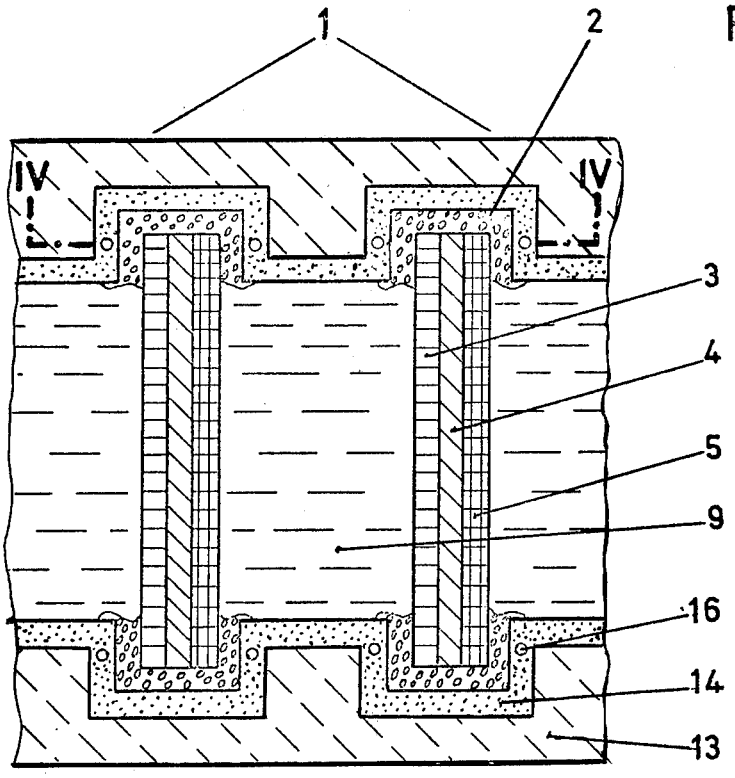

FIG. 3 A horizontal section through a part of an electrolytic furnace with electrode plates fixed into recesses in the trough.

Figure 4:
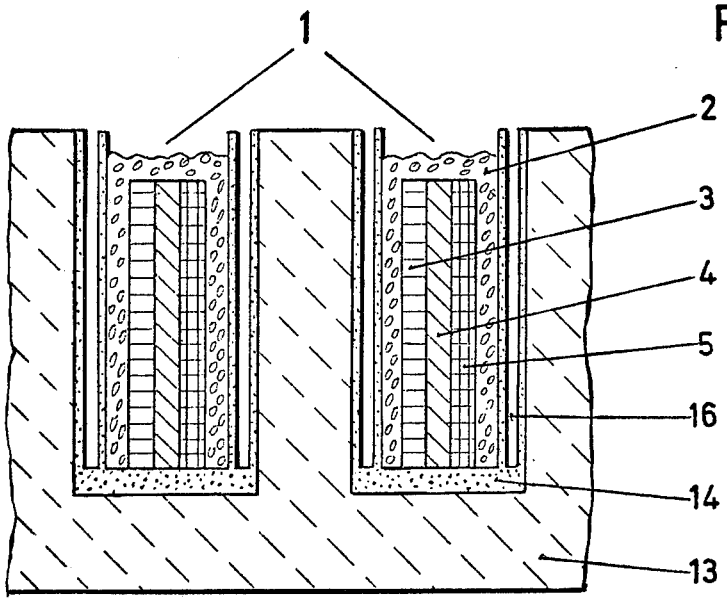

FIG. 4 A vertical cross section IV — IV of the design shown in FIG. 3.

The electrode 1 shown in FIG. 1 has a frame 2 consisting of badly conducting and electrolyte resistant material, for example electro-melted $Al_2O_3$ or MgO. Three plates are fitted into this frame viz:

A sintered anode plate 3, made of ceramic oxide material, an intermediate layer forming a plate 4 which conducts well, and a cathode plate 5. The intermediate layer 4 should prevent a reaction taking place between anode plate 3 and cathode plate 5 at the operating temperature. The suspension of the electrodes in the furnace is made easier if two projections 6 are provided in the frame 2.

FIG. 2 shows a multi-cell furnace, constructed using the vertical electrodes 1, shown in FIG. 1, and consisting of frame 2, anode layer 3, intermediate layer 4 and cathode layer 5. To advantage, however, these are positioned at an angle in order to prevent as far as possible the reoxidation of the precipitated aluminum by the oxygen escaping to the top. Busbar 7 leads to the anode at the end of the cell; busbar 8 leads to the cathode at the other end of the cell. The top surface of the electrolyte melt 9 is to advantage so adjusted that it lies in the region of the upper edge of the frame of the electrode. At least that part of the anode surface which is not covered by the frame is, therefore, completely immersed in the electrolyte melt. Thus the free anode surface is prevented from coming into contact with the atmosphere 15 and from being attacked by it. The cathodically precipitated aluminum 10 is collected in channels whilst the anode gas is drawn off through an opening 11 in the top of the cell 12, which is clad with fire resistant brick. The trough lining 13 does not function as a cathode; it is covered with an electrically insulating intermediate layer 14 which is resistant against attack from the molten electrolyte 9 and the liquid aluminum 10.

In the versions according to FIG. 3 and 4 it is shown how the individual parts of the electrodes 1 can be held together without frames or else before the application of a holding device. An electrolytic furnace is so designed that the anode plates 3, the intermediate layers 4 and the cathode plates 5 of the electrodes are held in place and insulated with solidified electrolyte material 2 in recesses which are formed in the trough lining 14. The electrolyte melt solidifies there because of the temperature drop in the recess of the trough wall arising out of the temperature gradient in the wall of the trough 13 of the electrolytic furnace.

Additionally, the solidification can be induced locally in the region of the electrodes by means of built-in cooling channels 16 in the furnace wall. Further there can be provided a heating device which to advantages uses the cooling channels to transport a heating medium and has the purpose of making the solidified electrolyte liquid again when necessary, thus permitting the plates to be changed. To tap off the liquid aluminum 10, the channels are provided for example with an outlet, out of which the aluminum flows under gravity into a collecting trough. To advantage the aluminum is drawn off from each channel individually in order to prevent local electrical by-passing through the molten aluminum, and thereby to prevent power losses.

EXAMPLE

Tin oxide with the following properties was taken as starting material for the anode.

| | |
|---|---|
| Purity: | >99.9 % |
| Theoretical Density: | 6.94 g/cm³ |
| Grain size: | < 5 micron |

To this material was added 2 % copper oxide and 2 % antimony oxide, each having a purity of >99.9 % and a grain size comparable to that of the tin oxide, and the whole was then dry mixed in a mixer for 10 minutes. About 500 g of this mixture was poured into a soft latex mould, having a rectangular recess 14.5 × 14.5 cm, pressed lightly by hand and placed in the pressure chamber of an isostatic press. The pressure was raised from 0 to 2000 kg/cm² over a period of 3 minutes, held for 10 seconds at maximum pressure and then the pressure was released within a few seconds.

The unsintered plate was taken out of the mould. It had the following dimensions:

11.5 × 11.5 × 1.08 cm

The density was 3.40 g/cm³

Over a period of 18 hours the plate was heated from room temperature to 1,350°C between two aluminum oxide plates in a furnace, held at this temperature for 2 hours and then cooled to 400°C over a period of 24 hours. After reaching this temperature, the sintered part was taken out of the furnace and after cooling to room temperature was weighted, measured and the density determined.

| | |
|---|---|
| Dimensions: | 10.3 × 10.3 × 0.70 cm |
| Measured Density: | 6.58 g/cm³ |
| % theoretical density of | 6.91 g/cm³: 95.2 % |

This plate was placed together with a square nickel plate of dimensions 10.1 × 10.1 × 0.5 cm and a graphite plate of dimensions 10.3 × 10.3 × 1.0 cm having a density of 1.84 g/cm³ in a frame of boron nitride having a density of 1.6 g/cm³. The nickel plate has slightly smaller dimensions, in order to compensate for its thermal expansion which is about three times greater than the other materials.

The structure of the electrode is as shown in FIG. 1. The outer dimensions of the boron nitride frame:

Length 14.3 cm; Height 12.3 cm; Breadth 4.2 cm.

The length here does not include the projections on the frame.

The recess for the anode, intermediate layer and cathode: Length 10.3 cm, Height 7.3 cm; Breadth 2.2 cm.

The rectangular window: Length 8.3 cm; Height 7.3 cm; Wall thickness 1.0 cm

For this system, $SnO_2$— Nickel — Graphite, assuming an ideal contact between the materials, the following resistance can be calculated:

| | Specific Resistance (Ohm.cm) | | Resistance per cm² (Ohm/cm²) | |
|---|---|---|---|---|
| | 20°C | 1000°C | 20°C | 1000°C |
| $SnO_2$ + 2 % CuO + 2% $Sb_2O_3$ | 0.065 | 0.0034 | 0.045 | 0.0024 |
| Graphite | 0.0012 | 0.0010 | 0.0012 | 0.0010 |
| Nickel | $7.8\times10^{-6}$ | $47\times10^{-6}$ | $3.9\times10^{-6}$ | $23.5\times10^{-6}$ |
| Total Resistance | | | 0.0462 | 0.0034 |

Under these ideal conditions, the voltage drop is 0.0029 Volts for a current density of 0.85 A/cm² and a